US007673770B2

(12) United States Patent
Summerfield

(10) Patent No.: US 7,673,770 B2
(45) Date of Patent: Mar. 9, 2010

(54) GRIPPING SLEEVE

(76) Inventor: Glenn Summerfield, 1103 Wildwood Ave., Manasquan, NJ (US) 08736

( * ) Notice: Subject to any disclaimer, the term of this patent is extended or adjusted under 35 U.S.C. 154(b) by 56 days.

(21) Appl. No.: 12/221,070

(22) Filed: Jul. 31, 2008

(65) Prior Publication Data

US 2008/0289148 A1 Nov. 27, 2008

Related U.S. Application Data

(63) Continuation-in-part of application No. 10/992,633, filed on Nov. 18, 2004, now abandoned.

(51) Int. Cl.
*B65D 25/10* (2006.01)
*B25G 1/10* (2006.01)

(52) U.S. Cl. ..... 220/755; 16/421

(58) Field of Classification Search ..... 220/755; 294/171; 16/411, 422, 428, 421
See application file for complete search history.

(56) References Cited

U.S. PATENT DOCUMENTS

| | | | | | |
|---|---|---|---|---|---|
| 2,371,639 | A | * | 3/1945 | Mason | 220/759 |
| 3,072,955 | A | * | 1/1963 | Mitchell | 294/171 |
| D372,865 | S | * | 8/1996 | Stowell et al. | D9/434 |
| 5,601,327 | A | * | 2/1997 | Cho | 294/171 |
| 5,926,912 | A | * | 7/1999 | Claphan | 16/411 |

* cited by examiner

*Primary Examiner*—Anthony Stashick
*Assistant Examiner*—Harry A Grosso
(74) *Attorney, Agent, or Firm*—Clifford G. Frayne

(57) ABSTRACT

A sleeve for enhancing a user's grasp of the handles and handholds of various tools and implements comprising: an elongated flexible hollow cylindrical sleeve having a first end, second end, interior wall surface, and exterior wall surface; and a lengthwise, non-radial slit from said first end to said second end, penetrating through said exterior wall surface to said interior wall surface.

3 Claims, 4 Drawing Sheets

GRIPPING SLEEVE

RELATED APPLICATIONS

This application is a continuation-in-part application of Ser. No. 10/992,633 entitled "Gripping Sleeve", filed Nov. 18, 2004 now abandoned.

BACKGROUND OF THE INVENTION

1. Field of the Invention

The present invention is directed to the field of gripping sleeves. In particular, the present invention is directed to a gripping sleeve, for enhancing a user's grasp of the handles and handholds of various tools and implements.

2. Description of the Prior Art

There have been a number of patents directed to the area of gripping sleeves. U.S. Pat. No. 5,524,885 discloses a slip-on grip with a main thin rubber cylindrical tube and an outer fabric layer dimensioned to fit securely over an existing grip. The outer fabric layer has longitudinal slits along its lower portion of the rubber tube to allow the tube to expand to slide over the existing golf grip during installation. The outer layer is made of cotton or terry cloth or similar material and is integral with the thin rubber tube to provide a non-slip, gripping surface. In a second embodiment, the golf grip has an additional, thickened interior rubber portion which replaces, instead of slipping over, the existing grip. The grip has the combined function of the existing grip and the grip cover providing a grip wide enough to fit in the palm of an adult's hand.

U.S. Pat. No. 6,098,199 discloses an apparatus for providing an enhanced grip between a gloved hand and a handle or other object to be gripped. A portion or all of the glove and a portion or all of the handle are provided with selected first and second gripping surfaces, respectively, of the same or different materials, that join together, temporarily or permanently, and provide a stronger hand-to-handle grip that resists slipping. Alternatively, a flexible band, having second and third gripping surfaces on opposite sides, is wrapped around a first object that is to be rotated or otherwise moved relative to a second object, such as a lid and a jar. A gloved hand, having a first gripping surface, grips the flexible band and the first object and forms a strong temporary join between hand, flexible band and first object, allowing the first object to be more easily moved. Various thermoplastic, amorphous polymers, crystalline polymers and rubber-like materials can be used for the gripping surfaces. The invention has application to construction, maintenance, control and extraction work, to sports activities, to repair work around the home and to persons suffering from arthritis and similar diseases that affect an ability to grip an object.

U.S. Pat. No. 5,560,083 discloses handles to carry luggage that have been made of a variety of materials and in a variety of styles. Some require specially molded, cast, or stamped parts of plastic, rubber or metal. But, such handles tend to be expensive and heavy. Here a handle is constructed from a pair or webbing pieces edge stitched to form an elongated tube into which a specially constructed filler member or core is inserted. This core comprises a central stiffening member of a tempered steel wire rod and a plastic tube. Several layers of foam padding are wound around this member, and the entire assembly is slid into the cavity formed by the edge sewn webbing pieces to form a grip. The lengths of the webbing pieces are such to form integral straps for attaching the grip directly to a luggage case.

U.S. Pat. No. 5,857,241 discloses a handle for a paint roller frame includes an inner core made of a substantially rigid plastic material and an outer grip made of a softer rubber-like material surrounding the inner core and extending part way around both ends thereof. At the outer end of the inner core is an internally threaded opening surrounded by a planar end wall. The outer grip includes an outer end portion overlying the planar end wall which acts like a locking washer, resisting unscrewing of an extension pole from the threaded opening when the extension pole is screwed down tight and a flange at a base of the extension pole threads come into contact with the outer end portion of the outer grip overlying the planar end wall.

Applicant deems the following three references as being the most relevant. U.S. Pat. No. 3,072,955 to Mitchell discloses a hand grip consisting of an elongated tubular body fabricated of resilient flexible material having a slit along one side for the full length thereof, the interior surface of the tubular body formed with a plurality of spaced apart longitudinal rib members, the hand grip designed to facilitate the carrying of shopping bags, buckets, and other containers, as well as cooking implements and hand tools, like pots, pans and screw drivers.

U.S. Pat. No. 2,444,558 to Elliot discloses a service handle for carrying articles having cord supports. The service handle being tubular and having a longitudinal bias slot for positioning the cord support within the longitudinal bore.

U.S. Pat. No. 2,394,050 to Goza discloses a shopping bag carrier having a longitudinal tubular body with a helically arranged slot extending from end to end through which the cords of a shopping bag may be slipped. The slot in Goza is a fixed slot in that it has a predetermined width and is not subject to closure by the resilient body.

The Elliot, Mitchell and Goza references address similar problems addressed by Applicant, but are structurally dissimilar in the manner in which they accomplish the task.

OBJECTS OF THE INVENTION

An object of the present invention is to provide for a novel gripping device which is easily installed over the handle of a tool or implement, such as the handle of a paint can.

Another object of the present invention is to provide for a novel gripping device which when positioned on the handle of a tool or an implement, provides a cushioned handle of greater circumference for ease of operation.

A still further object of the present invention is to provide for a novel gripping device which can be positioned over an implement such as a pen or pencil, which gripping device provides conformation to the hand of the individual in utilizing the implement.

A still further object of the present invention is to provide for a novel gripping device which is selectably removable from the tool or implement to which it is secured.

SUMMARY OF THE INVENTION

The present invention is a gripping sleeve for enhancing a user's grasp of the handles and handholds of various tools and implements comprising: an elongated flexible hollow cylindrical sleeve having a first end, second end, interior wall surface, and exterior wall surface; and a lengthwise, non-radial slit from said first end to said second end, penetrating through said exterior wall surface to said interior wall surface.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
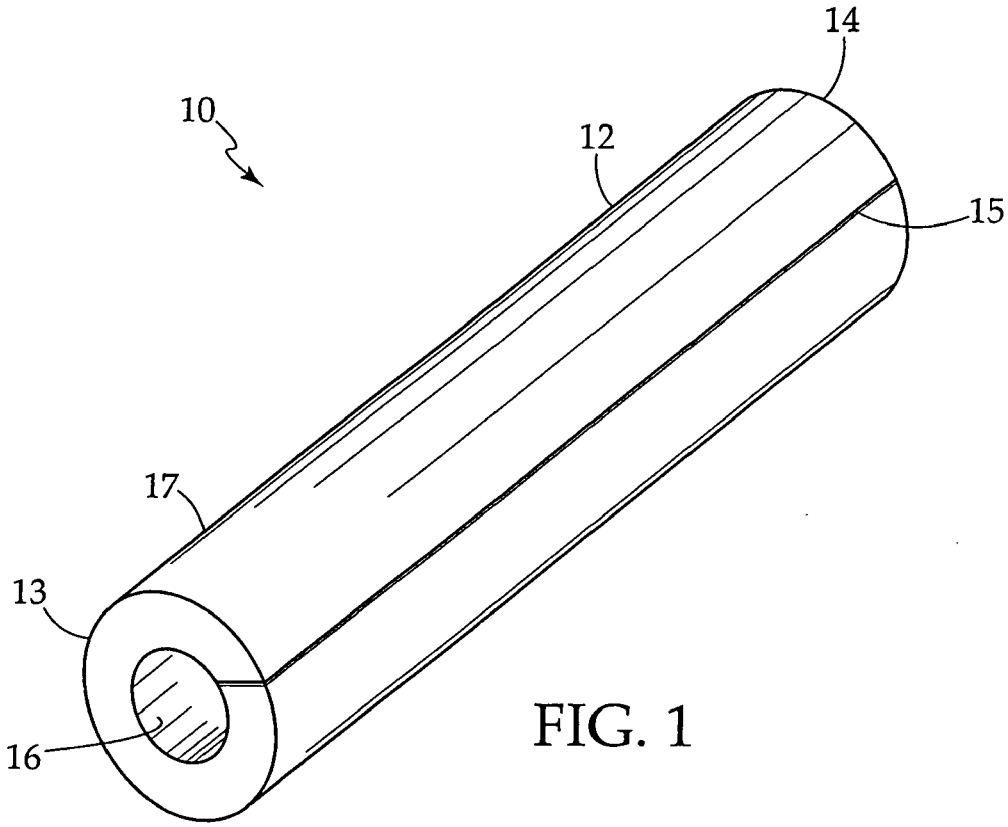
FIG. 1 is a perspective view of a first embodiment of a gripping sleeve of the present invention.
Figure 2:
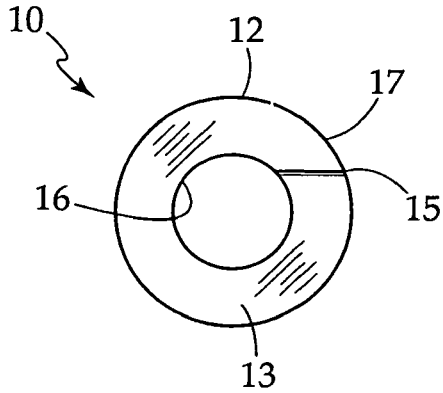
FIG. 2 is an end view of the first embodiment of the present invention.

Referring now to the drawings wherein like reference numerals refer to the same components across several views, and in particular to FIG. 1, there is shown a perspective view of a gripping sleeve 10 for enhancing a user's grip of the handles and handholds of tools and other implements, and FIG. 2 is an end view. The invention can be constructed from neoprene or other oil resistant, chemical resistant, and flexible material. The gripping sleeve 10 is comprised of a tubular elongated flexible hollow member 12. In a preferred embodiment, said elongated flexible hollow member 12 would be a cylindrical sleeve. In alternate embodiments, said elongated flexible hollow member 12 could be formed into a square, triangular, or polygonal profile.

The elongated flexible hollow member 12 includes a first end 13, second end 14, internal wall surface 16, and external wall surface 17. The elongated flexible hollow member 12 further includes a lengthwise slit 15 extending from the first end 13 to the second end 14. Slit 15 allows splitting the elongated flexible hollow member 12 from its first end 13 to its second end 14, splitting the gripping sleeve open, so a user dividing the lengthwise slit 15 with their hand can expose the elongated flexible hollow member's 12 hollow interior. Slit 15 is non-radial in relationship to the longitudinal axis of elongate flexible hollow member 12. Slit 15 is a partial chord in cross sectional relationship to elongated flexible hollow member 12. This offset prevents the sleeve 10 from inadvertently slipping off after it is applied to the can handle.

Figure 3:
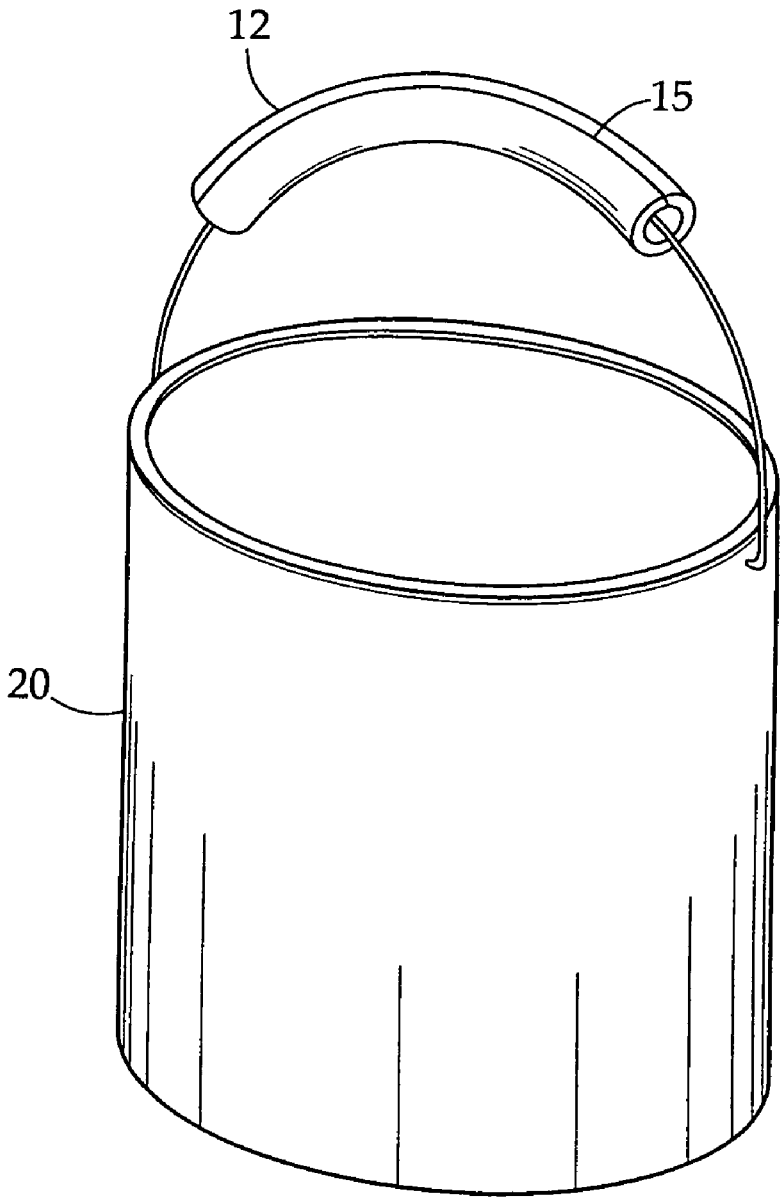
FIG. 3 is an elevational view of the first embodiment of the present invention affixed to the handle of a can.

A preferred method of using a gripping sleeve 10 is illustrated in FIG. 3. The preferred method of using a gripping sleeve 10 to enhancing a user's grip on the handles and handholds of tools and other implements is comprised of the steps, including, first, splitting the gripping sleeve 10 along its lengthwise slit 15, second, feeding the handle or handhold of the tool or implement through the gripping sleeve's 10 lengthwise slit 15, and, finally, utilizing the gripping sleeve 10 to grip a tool or implement more securely and comfortably. This method of use is illustrated in FIG. 3 with respect to a paint can.

The present invention is in no way restricted to a particular size or geometric configuration.

Figure 4:
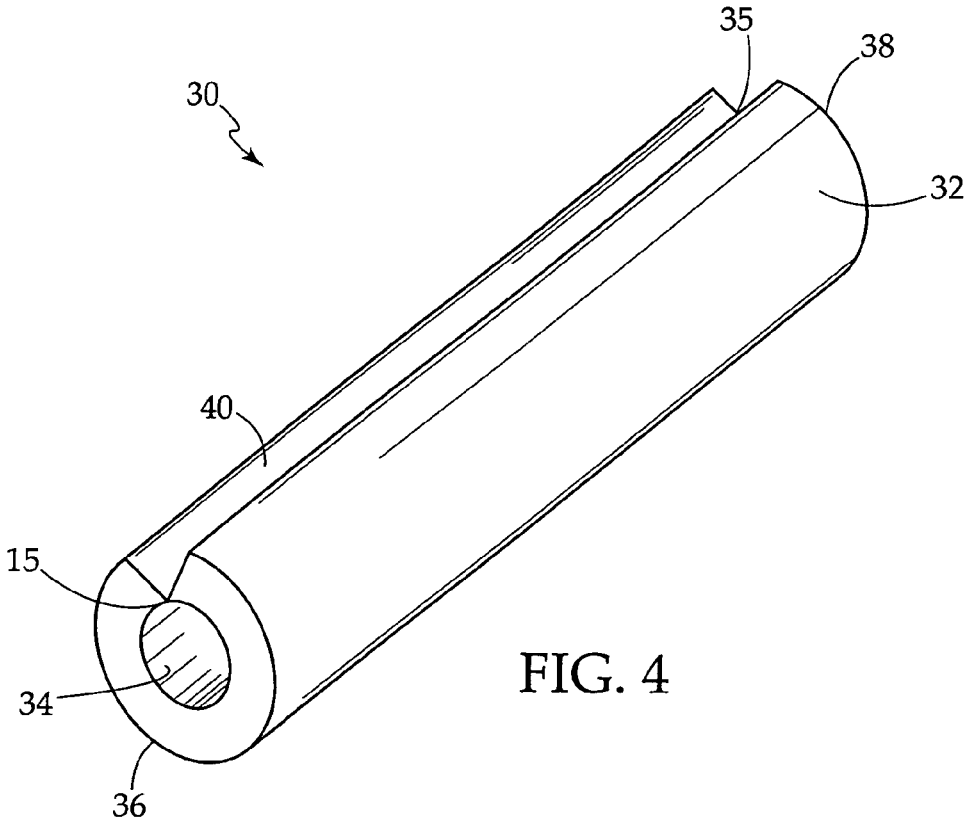
FIG. 4 is a perspective view of a second embodiment of the present invention for use with a hand implement such as a pen or pencil.
Figure 5:
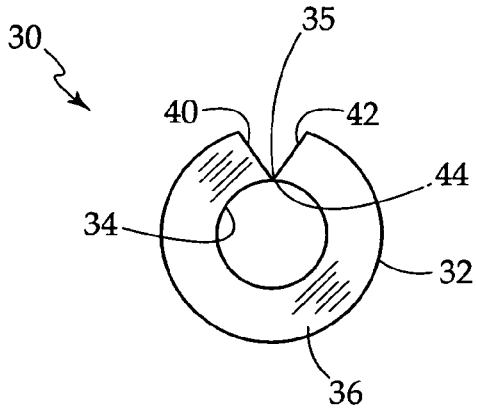
FIG. 5 is an end view of the second embodiment of the present invention.

FIGS. 4 and 5 illustrate a variation of the elongated flexible hollow member 12 as illustrated in FIGS. 1, 2, and 3. Flexible hollow member 30 of FIGS. 4 and 5 comprises a flexible tubular member which can be constructed from neoprene or other oil resistant, chemical resistant, and flexible tubular material. The elongate flexible hollow member 30 is generally cylindrical in shape having an outer cylindrical surface 32 and an inner cylindrical surface 34. Outer cylindrical surface 32 is interrupted by a longitudinal V-shaped groove 35 extending from first end 36 to second end 38 of flexible hollow member 30. Groove 35 interrupts the generally circular cross section of the flexible hollow tubular member 30 with a V-shape having opposing, angled planar surfaces 40 and 42 extending from the outer cylindrical surface 32 proximate the inner cylindrical surface 34. At the vertex 44 of the V-shaped groove 35, there is formed a slit 15 extending from the first end 36 to the second end 38 of flexible hollow tubular member 30.

Figure 6:
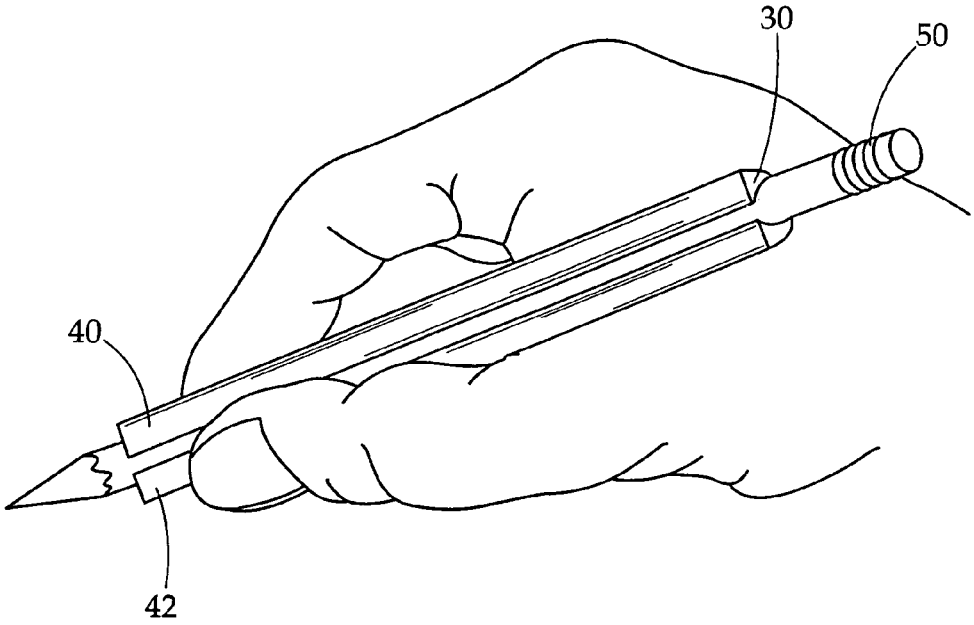
FIG. 6 is a perspective view of the second embodiment of FIGS. 4 and 5 positioned in cooperation with a pencil.

Flexible hollow tubular member 30 is designed to be engaged with a hand implement such as a pen or a pencil 50 (See FIG. 6). The hollow cylindrical tubular member 30 is split along slit 15 at the vertex 44 of the V-shaped groove 35, so that a pen, pencil or stylus 50 can be positioned within the tubular bore of flexible hollow tubular member 30. When a writing instrument is so positioned, the complimentary longitudinal surfaces 40 and 42 of the V-shaped groove 35 are extended such that they no longer form a V-shaped groove, but are co-planar presenting a planar surface which the user would engage with the thumb of his writing hand. This embodiment of the gripping sleeve presents a soft, flexible, comfortable surface on its cylindrical outer surface for the fingers of the writer and a planar comfortable surface for the thumb of the writer allowing the writer a larger more comfortable gripping surface for the writing instrument of choice.

The present invention has been described with reference to the preferred embodiments thereof. It is to be appreciated that other embodiments fulfill the spirit and scope of the present invention and that the true nature and scope of the present invention will be determined with reference to the claims attached hereto.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A gripping sleeve for enhancing a user's grasp of the handles and handholds of various tools and implements, and in particular, paint cans, said gripping sleeve comprising:

an elongated flexible hollow cylindrical sleeve having a first end, second end, an interior cylindrical wall surface, and exterior cylindrical wall surface; and a lengthwise slit extending from said first end to said second end, penetrating through said exterior wall surface to said interior wall surface, said lengthwise slit defining opposing planar slit side walls in abutting yet separable relationship for receipt within said flexible hollow cylindrical sleeves of handles and handholds of said various tools and implements, said lengthwise slit is parallel to an elongate axis of said hollow cylindrical sleeve, said lengthwise slit being non-radial in relationship to said axis of said hollow, cylindrical sleeve.

2. A gripping sleeve in accordance with claim 1 wherein said lengthwise slit extending from said first end to said second end of said flexible, hollow, cylindrical sleeve is V-shaped having two opposing angled planar surfaces, said planar angled surfaces defining a planar gripping surface when said flexible, hollow, cylindrical sleeve is positioned about a writing implement.

3. The gripping sleeve in accordance with claim 1 wherein said gripping sleeve is constructed of an oil resistant, chemical resistant material such as neoprene.

* * * * *